US006899346B2

(12) United States Patent
Pfeiffer

(10) Patent No.: US 6,899,346 B2
(45) Date of Patent: May 31, 2005

(54) SYSTEM FOR TRANSPORTING ITEMS OF LUGGAGE

(75) Inventor: Michael Pfeiffer, Faistenhaar (DE)

(73) Assignee: MP Michael Pfeiffer Design & Marketing GmbH, Hofolding (DE)

( * ) Notice: Subject to any disclaimer, the term of this patent is extended or adjusted under 35 U.S.C. 154(b) by 147 days.

(21) Appl. No.: 10/312,558

(22) PCT Filed: Jul. 12, 2001

(86) PCT No.: PCT/EP01/08083

§ 371 (c)(1),
(2), (4) Date: Mar. 5, 2003

(87) PCT Pub. No.: WO02/03829

PCT Pub. Date: Jan. 17, 2002

(65) Prior Publication Data

US 2003/0184034 A1 Oct. 2, 2003

(30) Foreign Application Priority Data

Jul. 12, 2000 (DE) ..... 100 33 698

(51) Int. Cl.[7] ..... B65B 1/04

(52) U.S. Cl. ..... 280/47.29; 280/37; 280/38; 280/40; 280/47.28; 280/47.26; 190/18 A; 190/110

(58) Field of Search ..... 190/107, 108, 190/110, 115, 116, 117, 15.1, 18 A; 280/37, 38, 40, 47.17, 47.18, 47.24, 47.26, 47.28, 655, 655.1, 651, 654, 47.29

(56) References Cited

U.S. PATENT DOCUMENTS 4,995,436 A * 2/1991 Cantor ..... 150/102
5,024,455 A * 6/1991 Schrecongost ..... 280/37
5,099,968 A * 3/1992 Kikuchi ..... 190/108
5,108,119 A * 4/1992 Huang ..... 280/37
5,167,306 A * 12/1992 Carrigan, Jr. ..... 190/18 A
5,219,976 A * 6/1993 Abele et al. ..... 528/86
5,323,886 A * 6/1994 Chen ..... 190/18 A
5,368,143 A * 11/1994 Pond et al. ..... 190/18 A
5,549,318 A * 8/1996 Ho ..... 280/654
5,575,361 A * 11/1996 Chou ..... 190/18 A
5,749,446 A * 5/1998 Hsieh ..... 190/107
6,183,133 B1 * 2/2001 Roegner ..... 383/39
6,341,789 B1 * 1/2002 Checa et al. ..... 280/47.28
6,592,133 B2 * 7/2003 Powell ..... 280/79.11

FOREIGN PATENT DOCUMENTS

DE 19855728 A1 * 6/2000 ..... B62B/3/04

* cited by examiner

*Primary Examiner*—Christopher R. Elus
*Assistant Examiner*—Kelly E Campbell
(74) *Attorney, Agent, or Firm*—Bacon & Thomas, PLLC

(57) ABSTRACT

The invention relates to a transporting system for items of luggage, in particular to a so-called wheeled case or trolley with releasable or exchangeable case elements. The transporting system for items of luggage comprises a rolling mechanism (10) and at least one item of luggage or case element (20), the rolling mechanism (10) having a wheel arrangement (11), a pulling device (12) and fastening means (13) for releasably connecting the item of luggage (20) to the rolling mechanism, and is characterized in that the fastening means (13), on the one hand, are connected to the rolling mechanism and, on the other hand, can be fixed in a releasable manner in an interior of the item of luggage (20). The fastening means may comprise, for example, touch-and-close fastener strips (13) which can be introduced into the interior of the item of luggage through slots (22) made in a rear wall (21) of the item of luggage (20), and can be fixed there on a touch-and-close fastener strip.

9 Claims, 4 Drawing Sheets

SYSTEM FOR TRANSPORTING ITEMS OF LUGGAGE

BACKGROUND

A. Field

The present invention relates to a system for transporting items of luggage, in particular to a so-called wheeled case or trolley with releasable or exchangeable luggage elements.

B. Related Art

Wheeled cases, which are also referred to as board cases or trolleys, usually have a packing case with rollers arranged on the base side. A retractable telescopic handle for transporting purposes is usually provided on the top side.

Such trolleys are known. In contrast to conventional cases, they have the advantage that they can be transported by rolling and thus reduce the user's load. For the case where a trolley cannot be rolled, for example when it is being transported on steps or over relatively rough terrain, additional handles are usually provided on one or more case sides, with the result that the trolley can also be carried like a conventional case. In order that the telescopic handle does not form an obstruction in these situations, it is usually of retractable design and can be retracted to the extent where it no longer projects beyond the outer periphery of the case. Also often provided on the packing cases are one or more front pockets which can be closed, for example, by zip fasteners or are designed as open pockets. It is possible for the packing case itself to comprise a single item of luggage or to be constructed in a modular manner from a plurality of case elements. The packing case often consists of a (synthetic) material which is compliant within certain limits. Trolleys made of a rigid, shell-like case material, however, are also known. On account of its easy handling, the trolley has been used widely in recent years by business travelers in particular.

The items of luggage or case elements of a wheeled case or trolley constitute relatively uncritical components from a production point of view. Depending on the target customer group, they may consist of relatively inexpensive plastic materials, but also of high-grade plastics, woven fabrics or even of leather. The subassembly of a wheeled case which involves the highest outlay in technical terms and also has the most decisive influence on the use properties, however, is the rolling mechanism, which essentially comprises a wheel arrangement and a pulling device, which is connected to the wheel arrangement and comprises the abovementioned telescopic handle. The wheel arrangement and the case element are usually assembled by the manufacturer of the wheeled case to form a unit which cannot be released by the user. In the meantime, however, wheeled cases are available for an extremely wide range of different purposes. For example, there are wheeled cases of which the case elements are optimized specifically for use as suitcases. Other wheeled cases are intended more to meet the requirements of businesspeople and can accommodate computer systems or printers, with the result that the wheeled case can be used as a mobile office. Other wheeled cases again are configured specifically for leisure or sports use.

If one wishes to use the different types of wheeled cases, then one is forced to buy a number of wheeled cases. Since each wheeled case has a complex and expensive rolling mechanism, the acquisition of a number of wheeled cases involves high costs. The present invention is thus based on the idea of providing a system for transporting items of luggage, in particular a wheeled case, which can be used in a versatile manner and in the case of which different items of luggage can be combined with one and the same rolling mechanism.

Such a transporting system for items of luggage which comprises a rolling mechanism and at least one item of luggage, the rolling mechanism having a wheel arrangement, a pulling device and fastening means for releasably connecting the item of luggage to the rolling mechanism, is described, for example, in German Utility Model DE 297 13 078 U1. In the case of the known transporting system, the item of luggage may be connected in a releasable manner to the rolling mechanism by means of a latching mechanism. The latching mechanism, however, is relatively complicated in mechanical terms and, accordingly, expensive to produce. Moreover, the known transporting system for items of luggage has the disadvantage that unauthorized individuals can actuate the latching mechanism arranged on the telescopic handle and steal the case element. It is also the case that, when the wheeled case of DE 297 13 078 U1 is transported on automatic conveyors, undesirable release of the latching mechanism may take place.

DE 198 55 728 discloses a rolling mechanism for transporting cases or travel bags. For fastening on the rolling mechanism, the case has threaded bores. Since the associated fastening screws are accessible from the outside, reliable theft prevention is not ensured since the case can easily be separated from the rolling mechanism.

Furthermore, German Patent DE 43 00 327 C2 describes a transporting system for a briefcase, which comprises a rolling mechanism and a briefcase which can be fastened in a releasable manner on the rolling mechanism by means of a clamping bracket. In the example described in this document, the fastening mechanism for the briefcase, although of relatively straightforward construction, does not comprise any reliable securing means for the item of luggage.

Moreover, the solutions described in the abovementioned German Patents are unsatisfactory from the point of view of esthetics, since it is merely the case that an essentially cuboidal case element is combined with a transporting system which, in terms of shaping, does not match this case element.

Finally, U.S. Pat. No. 4,647,056 discloses a portable rolling mechanism for items of luggage in the case of which the item of luggage which is to be transported is strapped on a platform provided with wheels.

BRIEF SUMMARY OF THE INVENTION

The object of the present invention is thus to provide a transporting system for items of luggage which, by virtue of a straightforward and cost-effective fastening mechanism, allows reliable and theftproof releasable fastening of one or more items of luggage or case elements on a trolley-like rolling mechanism. The transporting system according to the invention here is intended to provide, in particular, a wheeled case which, from the point of view of esthetics, realizes a unit comprising rolling mechanism and case elements.

This object is achieved by a transporting system for items of luggage which comprises a rolling mechanism and at least one item of luggage or case element, the rolling mechanism having a wheel arrangement, a pulling device and fastening means for releasably connecting the item of luggage to the rolling mechanism. The transporting system according to the invention is characterized in that the fastening means, on the one hand, are connected to the rolling mechanism and, on the other hand, can be fixed in an interior of the item of luggage or of one of the case elements. The fastening means are preferably fixed to the rolling mechanism and can be guided into an interior of the item of luggage via through-passages adapted to the dimensions of the fastening means, and fastened there, by the user.

With the rolling mechanism and item of luggage in the assembled state, the transporting system according to the invention largely corresponds to a conventional wheeled case, but with the advantage that the case elements can be exchanged by the user or used, independently of the rolling mechanism, as hand-held or shoulder-carried cases. The releasable fixing of the fastening means in the interior of the item of luggage has the advantage that the connection between the rolling mechanism and item of luggage is largely protected against unauthorized individuals gaining access thereto. Accidental release of the connection is also prevented in an effective manner. Particularly effective protection of the releasable connection between the rolling mechanism and item of luggage is realized when the interior of the item of luggage can be closed, but in particular closed off. For example, items of luggage or luggage elements of wheeled cases often have zip fasteners for closing their interior. It is possible in this case for the pull tabs of two of said fasteners to be secured by a small combination lock. The combination lock may be a straightforward padlock or a locking system which is integrated in the case element or in the frame of the case. It is easily possible, however, for the authorized user to open the case and release the retaining bands. The user can thus convert the wheeled case quickly into a hand-held case and vice versa or, if desired, fasten a different case element on the wheeled case. A single rolling mechanism can thus be used to realize a wide range of different wheeled-case and hand-held-case combinations. The costs of acquiring a single rolling mechanism and a number of exchangeable case elements are considerably lower than the costs of acquiring a number of complete wheeled cases.

It is possible to use a wide range of different items of luggage or case elements with the transporting system according to the invention. All that is required is for the items of luggage to be configured such that the fastening means of the rolling mechanism can engage in the interior of the item of luggage, where they are fixed by the user.

A wide range of different systems which can engage into the interior of the item of luggage through suitable openings in the latter, and can be releasably fixed, locked or arrested there, are possible as the fastening means. According to a preferred embodiment of the transporting system according to the invention, the fastening means comprise at least one retaining band or cable which can be introduced into the interior of the item of luggage through openings made in a rear wall of the item of luggage. The retaining band is then fixed in the interior of the item of luggage. The openings in the rear wall of the item of luggage may be defined, for example, as slots, of which the dimensions are adapted to the dimensions of the retaining bands. The slots may be provided with elastic sealing lips which position themselves closely against the retaining bands. The sealing lips also ensure that the interior of the item of luggage is largely sealed when the latter is used, without the rolling mechanism, in the manner of a hand-held case or of a shoulder bag. The fastening means designed as retaining bands constitute a system, for releasably fastening the item of luggage on the rolling mechanism, which is straightforward and cost-effective to produce and, in particular, easy to handle. All that is required is for the user to open the item of luggage, to release one end of the retaining bands in the interior of the item of luggage and to remove the item of luggage from the rolling mechanism. In this case, the retaining bands slide out through the openings or slots and the rolling mechanism and the item of luggage are separated. It is then possible for the user to fit, for example, a different item of luggage on the same rolling mechanism by moving the slots of the new item of luggage close up to the retaining bands, introducing the retaining bands into the slots from the outside and then tightening and fixing the retaining bands in the interior of the item of luggage.

According to an advantageous embodiment, the retaining band is designed at least in part in the region which can be introduced into the interior of the item of luggage as a touch-and-close fastener band which can interact with touch-and-close fastener strips fitted on an inner surface of the rear wall of the item of luggage. "Touch-and-close fastener band" and "touch-and-close fastener strips" are to be understood, in the present context, quite generally as the interacting, complementary parts of the touch-and-close fastener means. By means of a touch-and-close fastener means, the retaining band can be fixed, and also released again, particularly easily in the interior of the item of luggage by the user.

According to another embodiment, the fastening means comprise at least one snap fastener which has a bottom part, fitted on the rolling mechanism, and a releasable top part, it being possible for the bottom part to be introduced into the interior of the item of luggage through openings made in a rear wall of the item of luggage. For example, the bottom part may have an elongate pin which projects into the interior of the item of luggage through the opening in the rear wall of the same. The opening is then, for example, a small hole, of which the diameter is only slightly larger than the diameter of the pin. This pin is locked by the top part of the snap fastener from the interior of the item of luggage, the diameter of the top part being larger than the diameter of the hole in the rear wall of the item of luggage. This fastening system is also cost-effective to produce and easy to handle. The top part of the snap fastener can be arrested, in a particularly preferred manner, on the bottom part by a closure lock and forms a type of safety closure which can only be released by actuation of the closure lock. Such safety closures are sold, for example, by Happich Fahrzeug-und Industrieteile GmbH under the registered trademark TENAX.

According to an advantageous development of the transporting system according to the invention, the rolling mechanism has an essentially horizontal base plate, which ensures support for the item of luggage. According to this embodiment, the item of luggage, for fastening on the rolling mechanism, is first of all set down on the base plate. Then, the fastening means, for example the retaining bands, are guided into the interior of the item of luggage through openings of the same, tightened as far as possible and fixed. The wheel arrangement of the rolling mechanism is usually also provided on the base plate. The base plate then serves, at the same time, as a support for the wheeled case as a whole and may have, for example, rubber protuberances of suitable length on its underside. According to an advantageous embodiment, the base plate also comprises an extendible platform, which guarantees additional stability when the wheeled case is set down. An extendible platform which can be used with the transporting system according to the invention is described, for example, in international patent application WO97/30607. A suitable extendible platform which can be realized particularly straightforwardly in mechanical terms is described in the applicant's international patent application WO 00/59332.

The fastening means, moreover, may comprise suitable retaining means which essentially take the weight of the item of luggage or of the luggage elements. There is no need for the retaining means to engage in the interior of the item of luggage. The retaining means may be, for example, a crosspiece which is provided on the rolling mechanism and against which a complementary protrusion of the item of luggage comes into abutment. According to another variant, the fastening means comprise at least one latch-in bushing in which a complementary hook, fitted on the rear wall of the item of luggage, can engage. This retaining system then essentially bears the weight of the item of luggage, with the result that a base plate (of extendible or non-extendible form) need not necessarily be provided. In particular in the case of luggage elements consisting of flexible, compliant materials such as leather or woven fabric, however, the base plate advantageously serves as additional support, which prevents deformation of the case element under high loading.

According to a particularly preferred embodiment, the rolling mechanism of the transporting system according to the invention has an essentially vertically oriented rear panel, which bears the fastening means, that is to say in particular the retaining bands and the latch-in bushings. The rear panel is preferably fixed to the telescopically extendible handle system of the pulling device. It is also possible for the telescopic handle to be integrated in the rear panel, with the result that, on the one hand, the sensitive telescopic mechanism is protected and, on the other hand, an esthetically pleasing rear termination surface of the wheeled case is formed. If a base plate is provided, the rear panel and the base plate are particularly preferably formed in one item. The rear panel and base plate may be in the form of, for example, an injection molding or a pressed or drawn plastic part. The wheel arrangement is particularly preferably arranged in the region where the rear panel and base plate are connected. According to a variant of the transporting system according to the invention, the wheel arrangement can be swung in when the telescopic handle is pushed together, as is described in more detail, for example, in the applicant's international patent application PCT/EP99/03232.

According to a particularly preferred embodiment of the transporting system according to the invention for items of luggage, the rear panel is designed as a preformed shell which is essentially adapted to the contour of the rear wall of the item of luggage. The shell-like design of the rear panel provides the item of luggage with additional lateral support. If the case elements consist of a relatively flexible material, use is preferably made of a stable shell made of a rigid plastic material, with the result that the case elements are protected and the wheeled case as a whole has sufficient stability. Moreover, it is possible for the shell border to engage, in part, around the item of luggage (or a number of case elements), so that the resulting wheeled case gives the impression of being an integrated unit comprising rolling mechanism and luggage elements. This variant is superior to transporting aids with releasable luggage elements, said transporting aids being conventional from the point of view of esthetics in particular.

DRAWING DESCRIPTION

The present invention is explained in more detail hereinbelow with reference to exemplary embodiments illustrated in the attached drawings.

DETAILED DESCRIPTION OF PREFERRED EMBODIMENTS OF THE INVENTION

Figure 1:
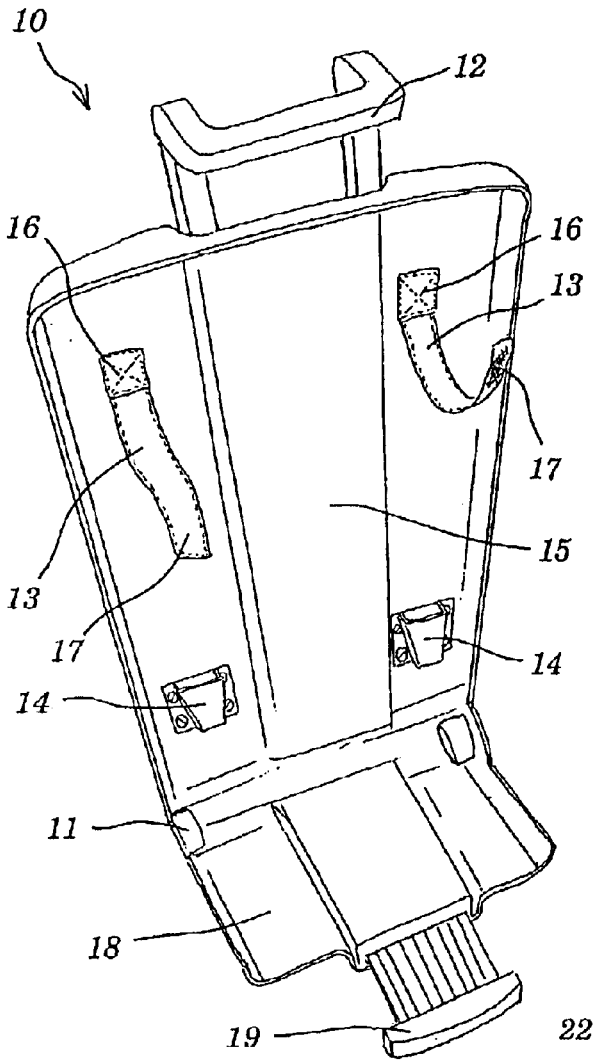
FIG. 1 shows a preferred embodiment of a rolling mechanism of the transporting system according to the invention for items of luggage.
Figure 2:
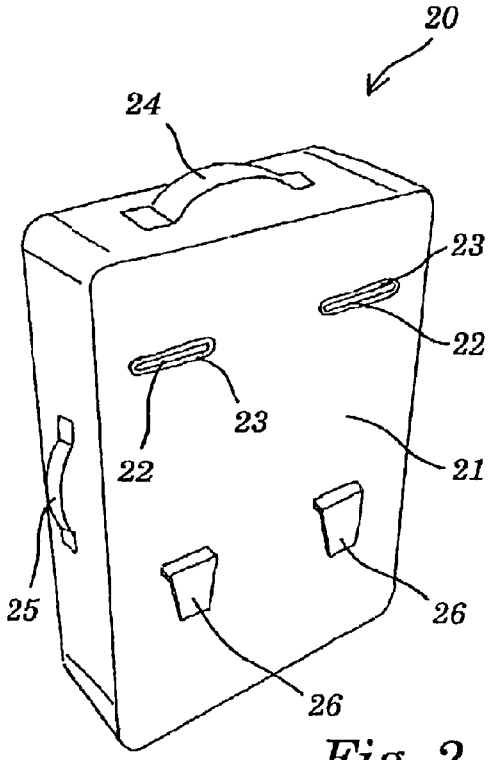
FIG. 2 shows a item of luggage which can be fastened on the rolling mechanism of FIG. 1.
Figure 3:
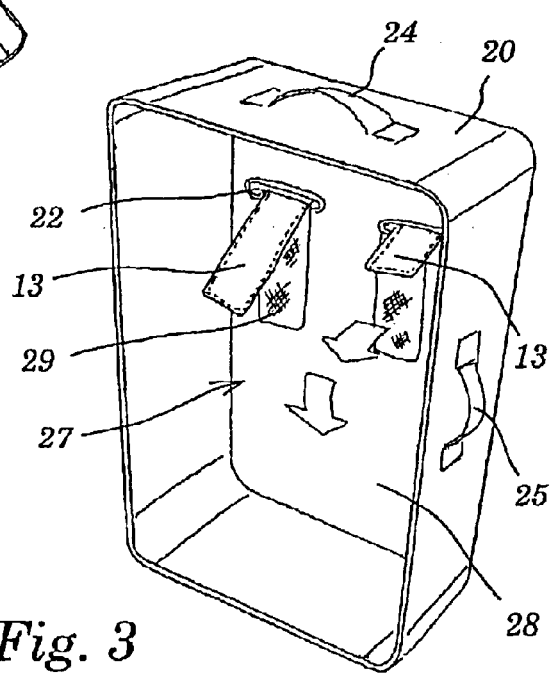
FIG. 3 shows the interior of the item of luggage of FIG. 2.

FIGS. 1 to 3 illustrate a first variant of a transporting system according to the invention for items of luggage. FIG. 1 shows a preferred embodiment of a rolling mechanism 10 of the transporting system according to the invention, this embodiment having a wheel arrangement 11 (see also the rear view of FIG. 6), a pulling device, designed as a telescopic handle 12, and fastening means 13 for releasably connecting a item of luggage to the rolling mechanism 10. In the example illustrated, the fastening means are designed as two retaining bands 13 which are arranged in the top region of a shell-like rear panel 15 of the rolling mechanism 10. In an end region 16, the retaining bands 13 are fixed, depending on the material, for example, welded, sewn or adhesively bonded, to the shell 15. As can be gathered from FIG. 3 in particular, the free ends 17 of the retaining bands 13 may be introduced into the interior 27 of a item of luggage 20. The fastening means of the rolling mechanism 10 also comprise two latch-in bushings 14 which are fixed in the bottom region of the shell 15. Finally, the rolling mechanism 10 also has a base plate 18 which is provided with an extendible platform 19.

FIG. 2 illustrates a item of luggage 20 which, in order to form a wheeled case, can be fastened on the rolling mechanism 10 illustrated in FIG. 1. For this purpose, the item of luggage 20 has a rear wall 21 which is brought into abutment against the inner surface of the shell 15 of the rolling mechanism 10. Slots 22 are made in the rear wall 21, their dimensions being adapted to the cross-sectional dimensions of the retaining band 13. The slots 22 are closed by elastic sealing lips 23, although the retaining bands 13 can be pushed through these. If the item of luggage 20 is removed from the rolling mechanism 10, the sealing lips 23 close the interior of the item of luggage, with the result that the latter can be used like a conventional case. Provided for this purpose, in the example illustrated, are carrying handles 24, 25, which are fitted on the side surfaces of the item of luggage 20. It is, of course, also possible to use shoulder straps (not illustrated here) or other carrying devices. Provided in the bottom region of the rear wall 21 are hooks 26 which can engage in the complementary latch-in bushings 14 of the rolling mechanism 10. The hooks 26 may be screwed, for example, into the rear wall.

FIG. 3 shows the interior 27 of the item of luggage 20, the figure, for the sake of clarity, not illustrating a closable cover which is normally provided. In the example illustrated, the retaining bands 13 project into the interior 27 through the slots 22 and can be fixed on touch-and-close fastener strips 29 fitted on the inner surface 28 of the rear wall 21 of the item of luggage 20, as indicated by the arrows in FIG. 3. Before the touch-and-close fastener strips are fixed, the hooks 26 provided on the rear wall 21 of the item of luggage 20 are positioned in the corresponding latch-in bushings 14 provided on the shell 15 of the rolling mechanism 10.

Figure 4:
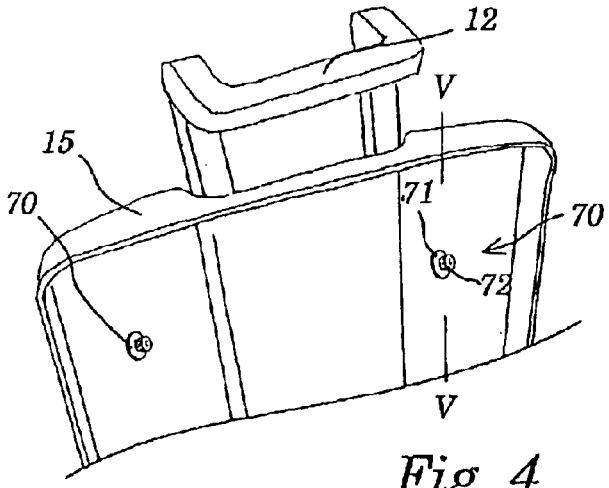
FIG. 4 shows an illustration, in detail form, of a variant of the rolling mechanism of FIG. 1.
Figure 5:
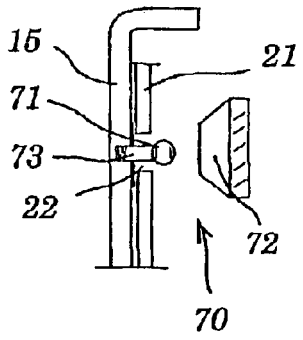
FIG. 5 shows a section along line V—V from FIG. 4.

FIGS. 4 and 5 illustrate a variant of the fastening means of the transporting system according to the invention. Elements which correspond to elements already described in conjunction with the embodiment of FIGS. 1 to 3 are provided with the same reference numerals. FIG. 4 shows an illustration, in detail form, of a rolling mechanism which essentially corresponds to the rolling mechanism 10 of FIG. 1. Instead of retaining bands, the rolling mechanism of FIG. 4, however, has snap-fastener-like fastening means 70 for fixing luggage elements. In the variant illustrated, the snap fasteners 70 each comprise a bottom part 71, which is fixed on the shell 15, and a releasable top part 72. In the configuration illustrated in FIG. 4, the rolling mechanism may be stored, for example, without the releasable top parts 72 getting lost. In order to install a item of luggage, the top parts 72 are first of all drawn off from the bottom parts 71. The item of luggage is then brought into abutment against the shell 15 of the rolling mechanism such that a pin 73 of the bottom part 71 projects through the openings 22 made in the rear wall 21 of the item of luggage. Finally, from the interior of the item of luggage, the top part 72 is positioned on the pin 73 of the bottom part 71, said pin projecting into the interior, and arrested, as is illustrated schematically in FIG. 5. FIG. 5 shows a section along line V—V from FIG. 4, a detail of the rear wall 21 of a item of luggage which is not illustrated in FIG. 4 also being indicated in FIG. 5. The diameter of the top part 72 of the snap fastener 70 is larger than the diameter of the opening 22 of the rear wall 21, with the result that the item of luggage can be secured in a releasable manner on the shell 15. If the snap fastener 70 is designed as a safety closure, the connection cannot be released accidentally even under pronounced loading.

Figure 6:
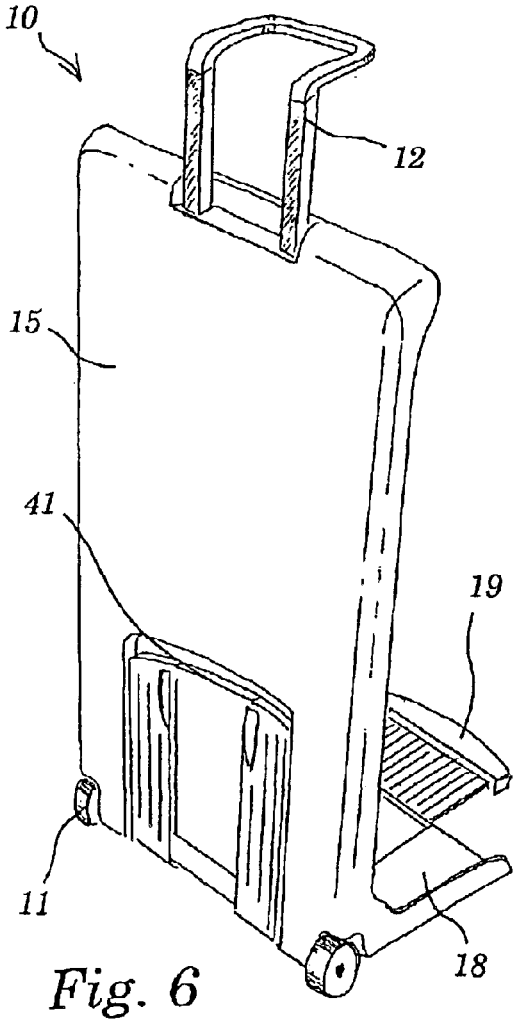
FIG. 6 shows a perspective illustration of the rolling mechanism of FIG. 1 as seen obliquely from the rear.
Figure 7:
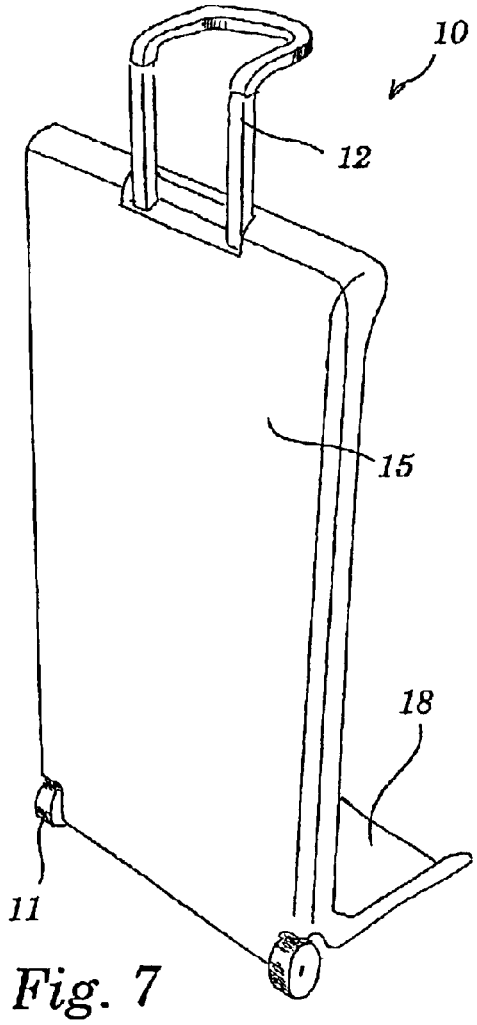
FIG. 7 shows an illustration, corresponding to FIG. 6, of a variant of a rolling mechanism according to the invention without an extendible platform.

FIGS. 6 and 7 illustrate two variants of the rolling mechanism 10 according to the invention. FIG. 6 shows a perspective view of the rolling mechanism of FIG. 1 as seen obliquely from the rear. In the variant illustrated, the rolling mechanism has an extendible platform 19, which can be actuated by a slide 41 provided on the rear side of the rolling mechanism. The design of such a platform is described in detail in the applicant's international patent application WO 00/59332, to which you are expressly referred, and is also explained briefly again hereinbelow with reference to FIGS. 13–15. The rolling mechanism illustrated in FIG. 7 largely corresponds to the rolling mechanism of FIGS. 1 and 6, although it does not have an extendible platform.

In the illustrated variants of the rolling mechanism 10, the telescopic handle is integrated in the shell 15, with the result that the handle mechanism is protected against damage and, at the same time, an esthetically pleasing design of the rolling mechanism is realized. Those borders of the rolling mechanism which engage over the items of luggage provide, when the case element has been inserted, a neat, compact overall impression of the wheeled case.

Figure 8:
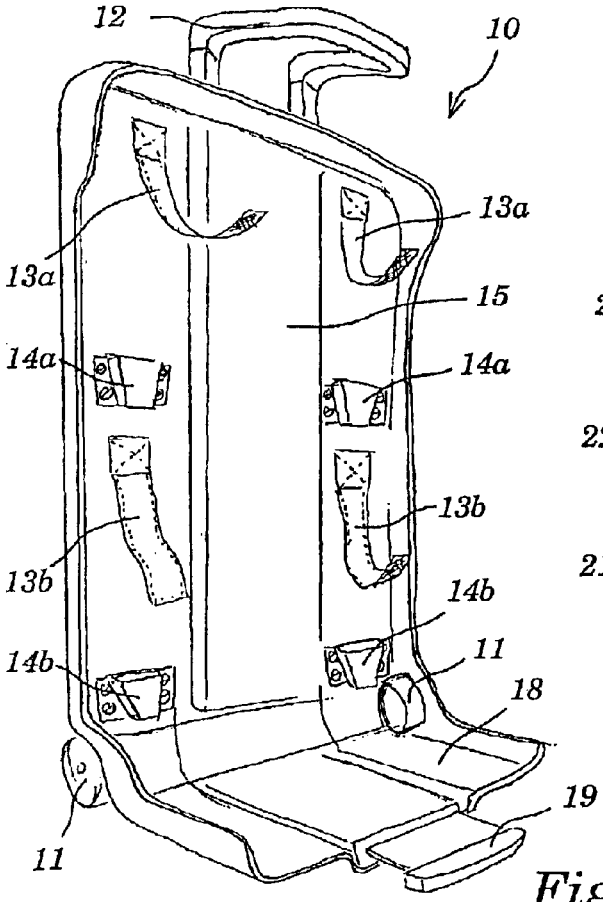
FIG. 8 shows an embodiment of a rolling mechanism which is provided for fastening two case elements.
Figure 9:
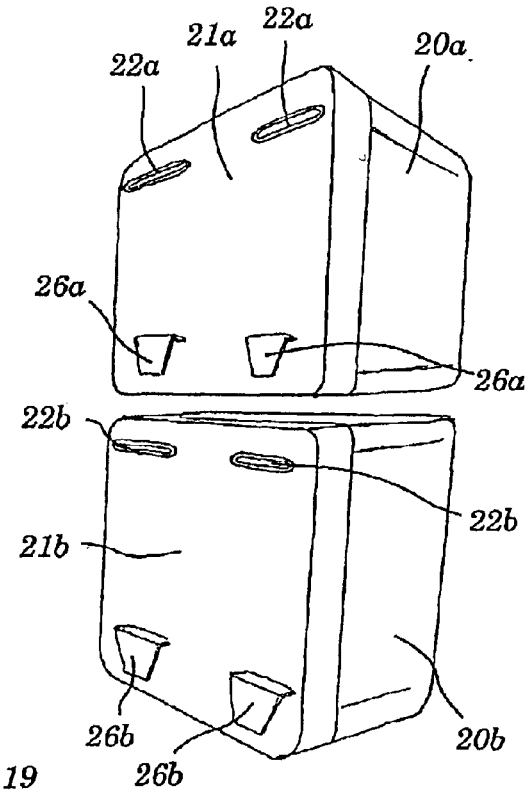
FIG. 9 shows two case elements which are suitable for fastening on the rolling mechanism of FIG. 8.

FIG. 8 illustrates a further variant of a rolling mechanism 10, on which two smaller case elements 20*a*, 20*b*, as are illustrated by way of example in FIG. 9, can be fastened. In order to fasten the case elements 20*a*, 20*b*, once again, the rear walls 21*a*, 21*b* of the latter are brought into abutment against the inner surface of the shell 15 and the fastening means are then fixed. The fastening means realized in this example essentially correspond to the fastening means of the rolling mechanism of FIG. 1. First retaining bands 13*a* are thus provided, and can engage in slots 22*a* of the first case element 20*a*. Likewise provided are latch-in bushings 14*a* in which the hooks 26*a* of the first case element 20*a* can engage. In order to fasten the second case element 20*b*, the shell 15 of the rolling mechanism has second retaining bands 13*b*, which can engage in slots 22*b* of the second case element, while hooks 26*b* can engage in second latch-in bushings 14*b*, which are fitted on the shell 15.

Figure 10:
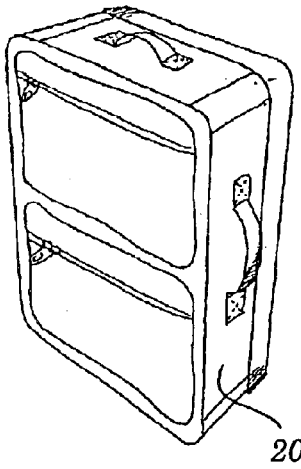
FIG. 10 shows a variant of a case element or item of luggage.
Figure 11:
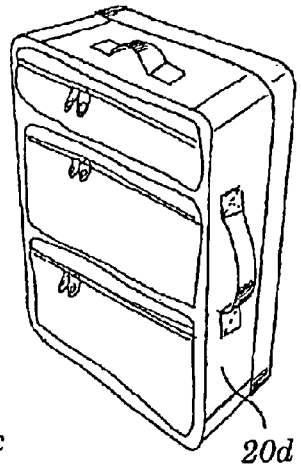
FIG. 11 shows a further variant of a case element or item of luggage.
Figure 12:
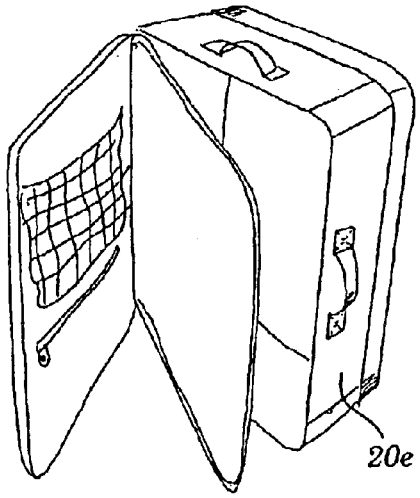
FIG. 12 shows a further variant of a case element or item of luggage.

FIGS. 10, 11 and 12 show different exemplary embodiments of respective items of luggage 20*c*, 20*d* and 20*e* which can be used with one and the same rolling mechanism. Accordingly, it is possible for the user to buy a wide range of different luggage systems with a single rolling mechanism and, if required, to purchase single case elements or items of luggage for specific purposes at a later date. These need not always be closed case elements. It is also possible to use open case elements which may be designed, for example, in the form of a golf bag or of a shopping bag.

Figure 13:
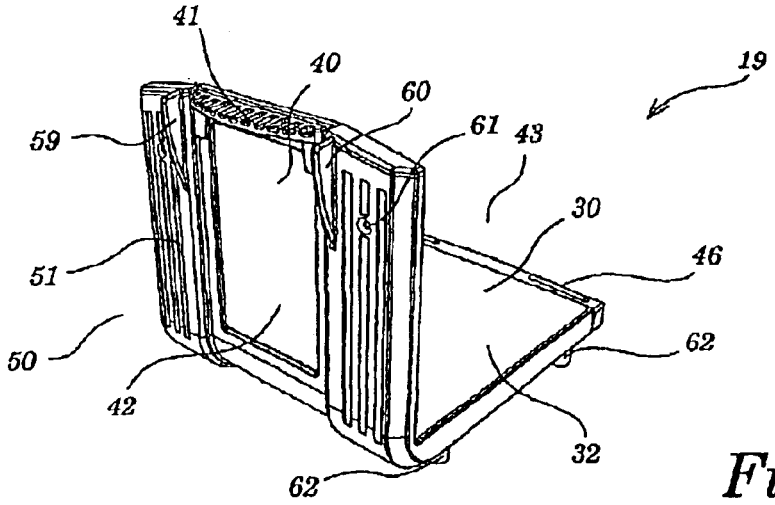
FIG. 13 shows a perspective illustration of a preferred embodiment of the platform module of the rolling mechanism of FIG. 1.

The platform module 19 which is already known from WO 00/59332 is illustrated in its entirety in FIG. 13. In the basic position illustrated here, the tread bar 41 is located at its top stop and the platform 43 is fully retracted. The dimensions of the module are selected such that, in this basic position, the platform 43 only projects to an insignificant extent, if at all, beyond the outer periphery of the base plate 18 and/or of the packing case 20 (see FIGS. 1 and 2).

Figure 14:
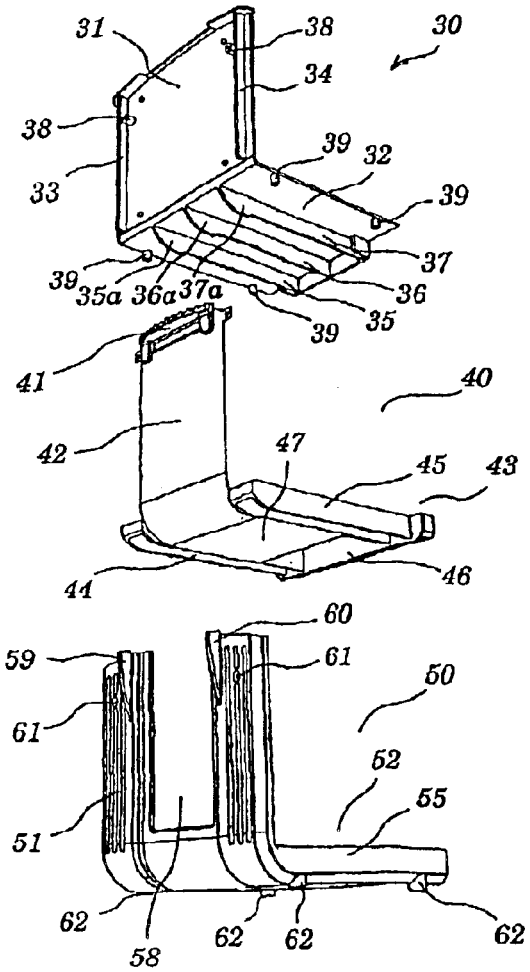
FIG. 14 shows an exploded illustration of the platform module of FIG. 13 in a first perspective view.
Figure 15:
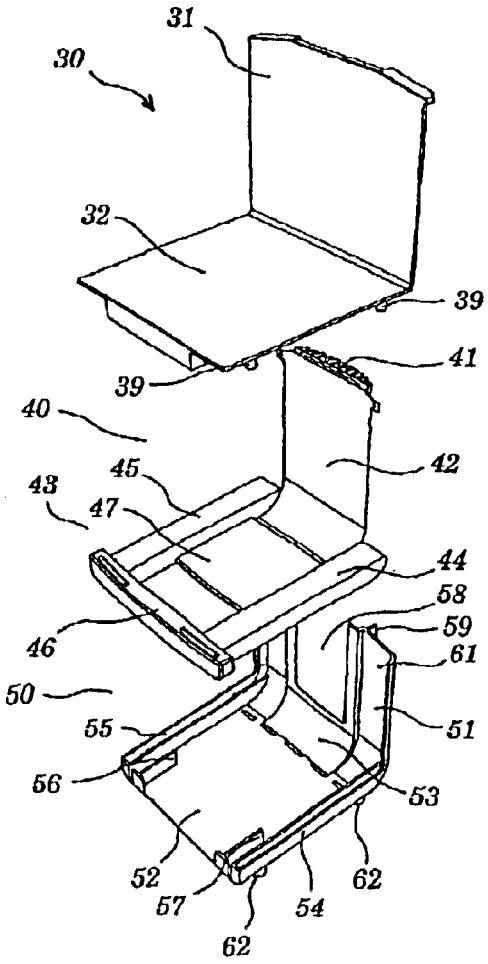
FIG. 15 shows an exploded illustration of the platform module of FIG. 13 in a second perspective view.

For the following detailed description of the construction of the platform module 19, you are also referred to the exploded illustrations of FIGS. 14 and 15. As can be gathered from FIGS. 14 and 15 in particular, the preferred embodiment of the platform module 19 which is illustrated comprises three in each case single-piece injection-molded components made of plastic: a first, essentially L-shaped guide element 30, which has an essentially vertically oriented front part 31 and an essentially horizontally oriented base part 32.

Also provided is a second guide element 50, which is of the same general L shape as the first guide element 30. It has a rear part 51 and a foot part 52, which is oriented essentially perpendicularly to the rear part. The rear part 51 has bores 61 into which it is possible to insert screws which can engage in corresponding threaded bores 38 provided on the front part 31 of the first guide element. Likewise provided in the foot part 52 of the second guide element 50 are bores 62 for screws (not illustrated) which, for the purpose of connecting the two guide elements, can engage in corresponding threaded bores 39 in the base part 32 of the first guide element 30.

Arranged between the two guide elements 30, 50 is a slide element 40, which is likewise in the form of a single-piece injection-molded component. The slide element 40 has a tread bar 41 and an extendible platform 43. In the example illustrated, the platform 43 comprises two longitudinal profiles 44, 45 which are connected at their front end by a crossbar 46. For additional stabilization, a flat, wide connecting crosspiece 47 is formed between the two longitudinal profiles 44, 45. The platform 43 and the tread bar 41 are connected to one another via a flexible band 42.

These three elements 30, 40, 50 of the platform module 20 are positioned one inside the other such that the slide element 40 can be displaced in a L-shaped interspace defined between the guide elements 30, 50. The displacement takes place here by virtue of the tread bar 41 being forced downward and/or the crossbar 46 being pushed back horizontally in the direction of the housing-like structure formed from the guide elements 30, 50. A cutout 48 is made into the rear part 51 of the second guide element, the width of said cutout essentially corresponding to the width of the tread bar 41 and its length being essentially equal to the maximum extension of the platform 43. The tread bar 41 can be displaced in this cutout 48.

It is possible for at least one of the guide elements 30, 50 to be formed integrally, for example with the base plate 18 and, if appropriate, also with the shell 15 of the rolling mechanism 10 (see FIG. 1).

As can be gathered from FIG. 15, the longitudinal profiles 44, 45 are designed as U-shaped profiles, of which the legs engage in corresponding guide rails 54, 55 which are integrally formed on the foot part 52 of the second guide element 50. The rails 54, 55 have stops 56, 57 which limit the movement of the longitudinal profiles 44, 45 of the slide element 40.

It is clear from the drawings that the tread bar 41 moves essentially exclusively in the vertical direction, while the platform 43 is only displaced in a horizontal direction. The two movements are coupled via a thin flexible plastic panel 42 which is deflected essentially through a 90° angle by the guide elements 30, 50. The guide elements 30, 50 here are deigned so as to avoid bends, folds or bulges being produced in the panel 42 perpendicularly to its surface. For this purpose, the second guide element 50, for example, has a guide surface 53 which is curved in the deflecting region, while pressure-exerting struts 35, 36, 37 are provided on the underside of the base part 31 and have their rear sections 35*a*, 36*a*, 37*a*, which are located in the vicinity of the guide surface 53, shaped essentially to complement the guide surface 53. The front part 31 of the first guide element 30 has lateral bars 33, 34 which, on the one hand, laterally terminate the arrangement comprising the first and second guide elements and, on the other hand, likewise perform a guiding function for the flexible panel or the flexible band 42.

For guidance of the tread bar 41 during actuation by the user, two lugs 59, 60 are also provided on the rear side of the rear part 51 of the second guide element 50.

It is possible, if appropriate, for suitable protuberances to be screwed into the bores 62 in the foot part of the second guide element, and these can be used as feet for the case 10.

What is claimed is:

1. A system for transporting items of luggage comprising: a rolling mechanism and at least one item of luggage, the rolling mechanism having a wheel arrangement, a pulling device and a fastening device arranged to releasably connect the item of luggage to the rolling mechanism, wherein the fastening device, on the one hand, is connected to the rolling mechanism and, on the other hand, is fixable in a releasable manner to the interior of the item of luggage;

the item of luggage including a device for closing the interior of the item of luggage;

the fastening device comprising at least one retaining band arranged to be introduced into the interior of the item of luggage through openings provided in a rear wall of the item of luggage; and wherein said retaining band is arranged as a touch-and-close fastener band arranged to interact with touch-and-close fastener strip fitted on an inner surface of the rear wall of the item of luggage.

2. The transporting system as claimed in claim 1, wherein the rolling mechanism includes an essentially horizontal base plate (18).

3. The transporting system as claimed in claim 2, wherein the base plate has an extendible platform.

4. The transporting system as claimed in one of claim 1, wherein the fastening device also comprises at least one latch-in bushing arranged to receive and engage a complementary hook fitted on the rear wall of the item of luggage.

5. The transporting system as claimed in one of claim 1, wherein the rolling mechanism has an essentially vertical rear panel, which carries the fastening device.

6. The transporting system as claimed in claim 5, wherein the rear panel and the base plate are formed in one piece.

7. The transporting system as claimed in claim 5, wherein the wheel arrangement is arranged in the region where the rear panel and base plate are connected.

8. The transporting system as claimed in claim 5, wherein the rear panel is configured as a preformed shell which is adapted to the contour of the rear wall of the item of luggage.

9. The transporting system as claimed in claim 1, wherein the wheel arrangement is arranged such that it is swingable inwardly.

* * * * *